US008449438B2

(12) United States Patent
Morin

(10) Patent No.: US 8,449,438 B2
(45) Date of Patent: May 28, 2013

(54) ADJUSTABLE STANDING MUSCULAR RELEASING AND STRETCHING EXERCISE DEVICE

(76) Inventor: Christopher Morin, Shrewsbury, MA (US)

( * ) Notice: Subject to any disclaimer, the term of this patent is extended or adjusted under 35 U.S.C. 154(b) by 0 days.

(21) Appl. No.: 12/846,612

(22) Filed: Jul. 29, 2010

(65) Prior Publication Data

US 2012/0028765 A1 Feb. 2, 2012

(51) Int. Cl.
*A63B 21/00* (2006.01)
*A63B 21/068* (2006.01)
*A63B 26/00* (2006.01)

(52) U.S. Cl.
USPC ..... 482/131; 482/95; 482/96; 482/142; 482/907

(58) Field of Classification Search
USPC ..... 482/148, 104, 10–11, 23, 38–42, 482/70, 79–80, 91–96, 131–138, 140–145, 482/907; D21/686, 691, 662, 673, 676
See application file for complete search history.

(56) References Cited

U.S. PATENT DOCUMENTS

| | | | | |
|---|---|---|---|---|
| 5,048,825 | A * | 9/1991 | Kelly | 482/94 |
| 5,069,447 | A * | 12/1991 | Snyderman et al. | 482/133 |
| 6,063,007 | A * | 5/2000 | Sithole | 482/52 |
| 6,309,330 | B1 * | 10/2001 | Thornton | 482/140 |
| 6,547,704 | B2 * | 4/2003 | Parrillo | 482/94 |
| 7,086,992 | B2 * | 8/2006 | Bowman et al. | 482/51 |
| 7,326,159 | B2 * | 2/2008 | Rong | 482/140 |
| 7,534,200 | B1 * | 5/2009 | Martinez | 482/142 |
| 2004/0009853 | A1 * | 1/2004 | Smith | 482/91 |
| 2004/0209745 | A1 * | 10/2004 | Riney et al. | 482/97 |

* cited by examiner

*Primary Examiner* — Oren Ginsberg
(74) *Attorney, Agent, or Firm* — Michael Ries

(57) ABSTRACT

The present invention is an adjustable standing muscular releasing and stretching exercise device for a user. The device has a vertical linear column base, a support handle that can be vertically moved and attached along the linear base, a pair of adjustable releasing rollers on a horizontal bar with a roller connection that is movably connected to the linear base, a horizontal floor base that is attached to and supports the linear base, a raised non-skid foot platform that is attached to and extends over said floor base and an adjustable non-skid calf step perpendicularly and slidably attached to said foot platform.

3 Claims, 3 Drawing Sheets

ADJUSTABLE STANDING MUSCULAR RELEASING AND STRETCHING EXERCISE DEVICE

The entire disclosure of U.S. Provisional Application 61/050,241 filed on May 4, 2008 is incorporated by reference.

TECHNICAL FIELD & BACKGROUND

The present invention generally relates to an adjustable muscular releasing and stretching exercise device. More specifically, the invention is an adjustable standing muscular releasing and stretching exercise device that can be used in a standing position by a user.

It is an object of the invention to provide an adjustable muscular releasing and stretching exercise device that has an adjustable rolling mechanism that can be adjusted anywhere along the vertical linear base of the adjustable releasing and stretching exercise device.

It is an object of the invention to provide an adjustable muscular releasing and stretching exercise device that has a roller mechanism that can be removed and attached to an exterior vertical support.

What is really needed is an adjustable muscular releasing and stretching exercise device that has an adjustable roller mechanism that can be adjusted along a wide range of positions along the muscular releasing and stretching device while a user is standing and can be removed and attached to an exterior vertical support.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
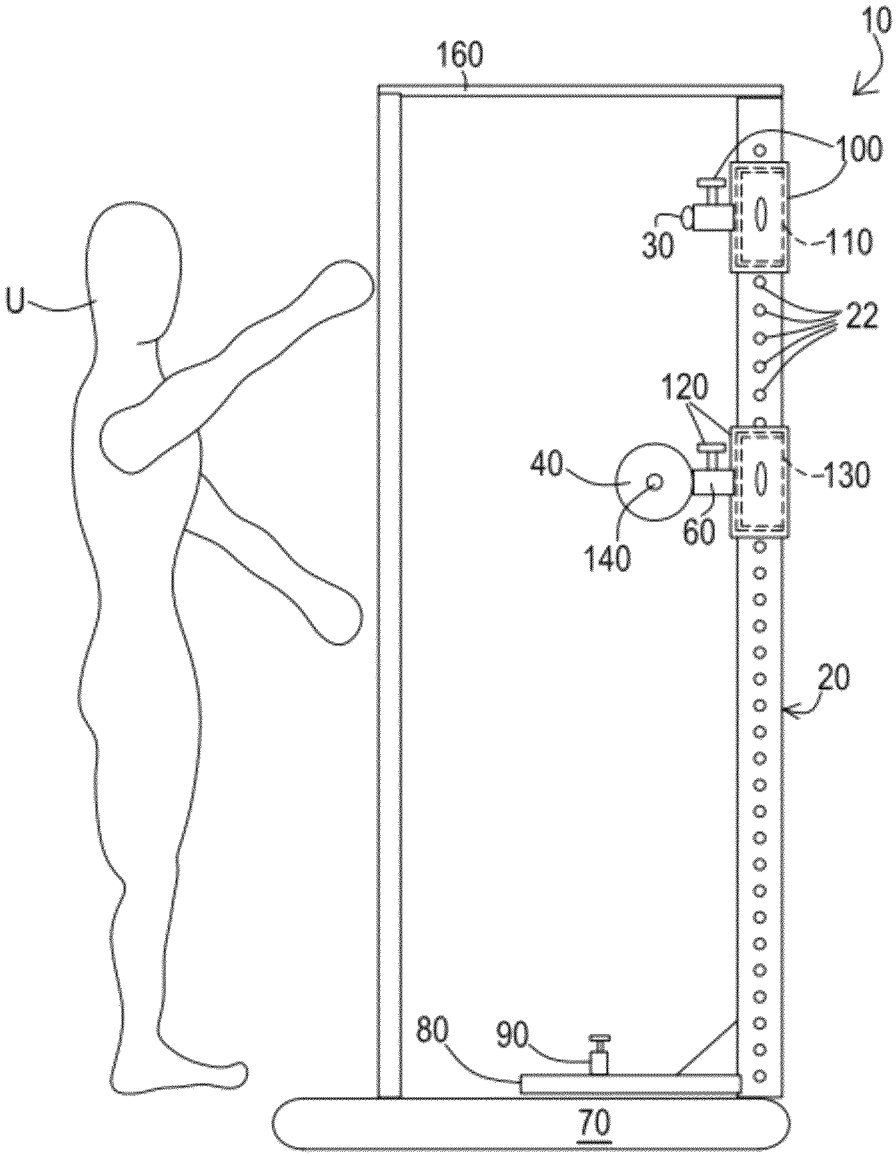
FIG. 1A illustrates a side perspective view of an adjustable muscular releasing and stretching exercise device, in accordance with one embodiment of the present invention.
Figure 1B:
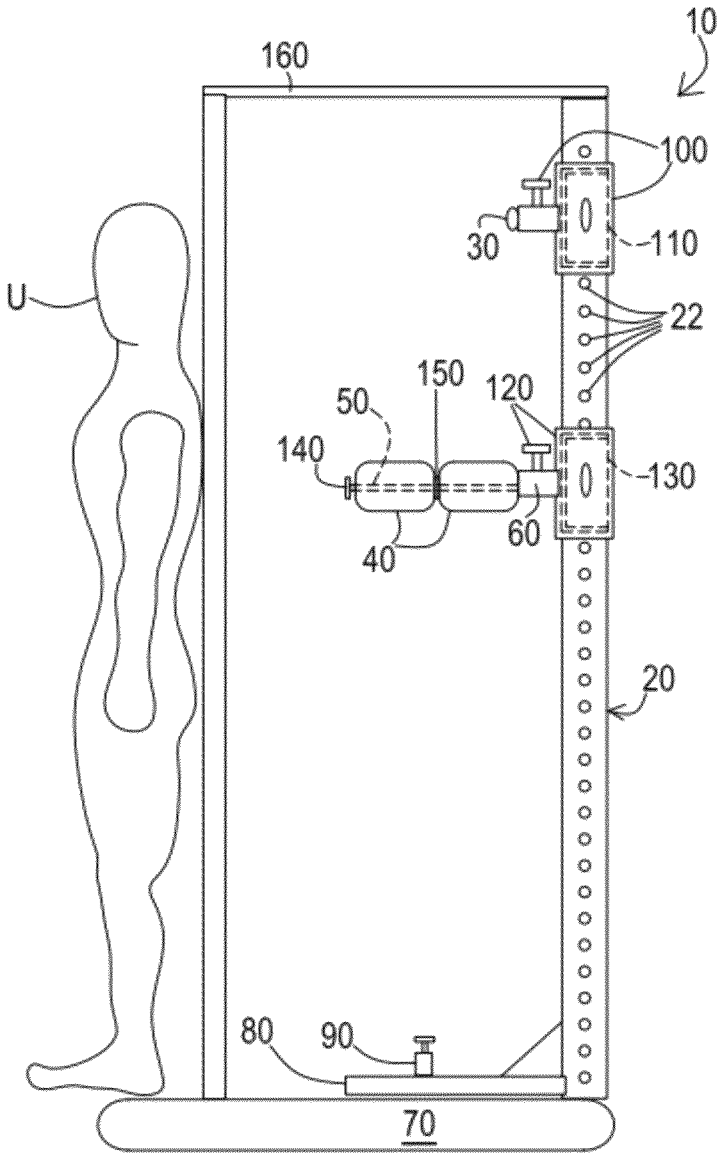
FIG. 1B illustrates a side perspective view of an adjustable muscular releasing and stretching exercise device with a pair of adjustable rollers being 90 degrees to each other, in accordance with one embodiment of the present invention.
Figure 2:
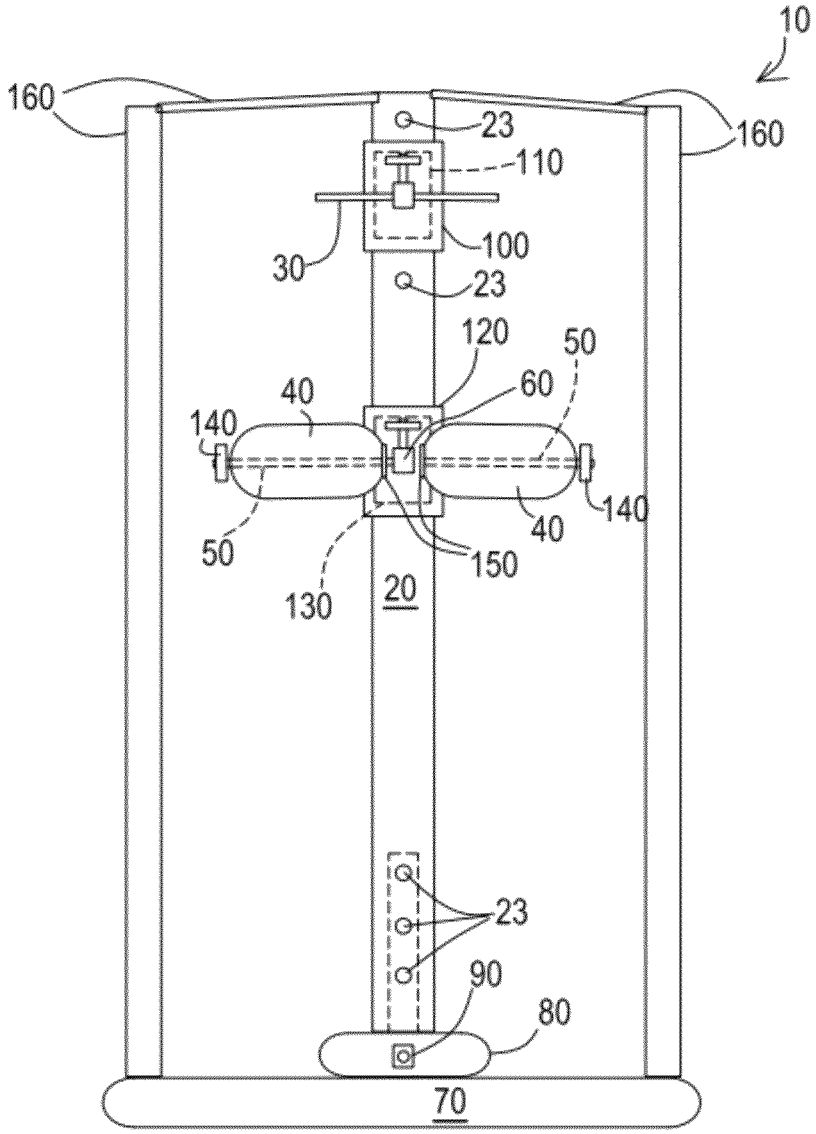
FIG. 2 illustrates a front perspective view of an adjustable muscular releasing and stretching exercise device, in accordance with one embodiment of the present invention.

FIG. 1A illustrates a side perspective view of an adjustable muscular releasing and stretching exercise device 10, in accordance with one embodiment of the present invention. FIG. 1B illustrates a side perspective view of an adjustable muscular releasing and stretching exercise device with adjustable rollers being 90 degrees to each other, in accordance with one embodiment of the present invention. FIG. 2 illustrates a front perspective view of an adjustable muscular releasing and stretching exercise device 10, in accordance with one embodiment of the present invention. Both FIG. 1A, FIG. 1B and FIG. 2 illustrate the features of an adjustable standing muscular releasing and stretching exercise device 10 for a user U. These features include a vertical linear column base 20, a support handle 30 that can be horizontally moved and attached along the linear base 20, a pair of adjustable releasing rollers 40 on a horizontal bar 50 with a roller connection 60 that is movably connected to the linear base 20, with the rollers 40 being removably slid and secured onto the bar 50. The device 10 also has a horizontal non-skid floor base 70 that supports the linear base 20, a raised non-skid foot platform 80 that is attached to and extends over the non-skid floor base 70 and an adjustable non-skid calf step 90 perpendicularly and slidably attached to the foot platform 80. There is also one or more vertical and horizontal supports 160 that provide more support and stability to the linear base 20 and overall device 10.

The linear base 20 is perpendicularly attached to the floor base 70 and is made of tubular steel and can be made of any other material or shape that is well known in the art. The support handle 30 serves as a dip bar, a pull-up bar and a handrail for stretches and functional training for a user U. The support handle 30 can also be used for other exercises that are well known in the art such as pull ups, reverse pull-ups, assisted pull-ups, dips, assisted dips, chest flies with body weight and ropes (or cables or chains), rows with body weight, rows with body weight and ropes, curls with body weight and ropes, triceps extensions with body weight, triceps extensions with body weight and handles, lower back extensions with support handle 30 and calf block, vertical knee raises, leaning squats with handles and calf block, one legged squats with handle, one legged squats with handle with legs crossed, closed chain hamstrings with calf block and support handle 30 and off step calf raises. Note that the support handle 30 can be used with balance disks (and stability balls) as well with any of the previously described exercises.

The handle 30 is attached to the linear base 20 by a tightening bolt and locking mechanism 100 that has a first inner plastic guide 110 for increased stability and strength. The tightening bolt and locking mechanism 100 interlocks the support handle 30 to the linear base 20 using a plurality of apertures 22 along the entire length of the linear base 20. The device 10 also has adjustable rollers 40, in addition to the vertical linear base 20, horizontal bar 50, and roller connection 60, that can be removed from the device 10 and attached to an outside vertical support for use. Such an outside vertical support can include any vertical support such as other gym equipment, a wall, a door frame, a vertical column or any other outside vertical support that is well known in the art. The rollers 40 can be removed from the horizontal bar 50 allowing the horizontal bar 50 to be used as a strengthening and stretching support handle as well. As illustrated in FIG. 1B, the adjustable rollers 40 can be set at a 90 degree angle to each other. There is also a roller connection 60 that is attached to the linear base 20 by a t-pin and locking mechanism 120, thereby securing the horizontal bar 50 by a plurality of apertures 22 interlocking with the t-pin and locking assembly 120 along the entire length of the linear base 20. The t-pin and locking mechanism 120 can also be positioned behind the device 10 so as to not be in the way of a user U while using the device 10. The t-pin and locking mechanism 120 also has a second inner plastic guide 130 for increased stability and strength. Both the rollers 40 and the support handle 30 can be moved and secured in position anywhere along the device 10. The rollers 40 themselves are removably secured on the horizontal bar 50 by a bushing, a cap screw and/or a spring collar assembly 140 on each distal end of each roller 40. The horizontal bar 50, through the roller connection 60 can be adjusted at different angles through the locking mechanism. The horizontal bar 50 is extended from the roller connection 60 by an axle holder and bushings 150 for the rollers 40. The rollers 40 are massage rollers and myofascial rollers and are also known in the art as self-muscular release rollers, self-myofascial release rollers, self-massage rollers, self-release rollers, self-acupressure rollers, self-trigger point release rollers and self-stretch rollers. The rollers 40 can be positioned to massage any user U body part accessible to the device 10 in a standing position or seated position for those who are handicapped.

The self-releasing rollers 40 can moved and adjusted from the top to the bottom of the device 10 or anywhere in between. The device 10 could be attached to existing gym equipment, a column of a home, a door frame or its own free standing system, as previously discussed. The vertical linear column base 20 has mounting holes 23 for mounting though bolts, clamps, and/or brackets. The device 10 will allow the changing of rollers 40 of different densities, thickness, textures and lengths to be used by the user U. The device 10 also allows other therapeutic devices to be attached to the horizontal bar 50 like revolving balls or a trigger point release rod or other therapeutic devices well known in the art. The addition of other attachments that compliment the device 10, such as a support handle, offer a greater amount of exercises and stretches that have been disclosed by current stretching and releasing devices. These attachments will allow for many strength and functional exercises that use body weight as resistance and that require a balance demand. The device's standing operating position make it possible for users U who find it difficult to move up and down the floor to self-treat themselves such as might be required by frail or injured users. The device's standing operating position allows improved regulation and control when compared to traditional floor rollers.

The device 10 could be used as an adjustable standing stretching device that allows the user U to release before stretching, which some fitness experts feel would create a better stretch. In many circumstances if someone has a muscle adhesion, also known as a knot, stretching will typically only work around the adhesion. Performing a self-release on the adhesion before stretching may allow for a complete stretch after the muscle has been released. Typically when a user U stretches, adhesion results are not achieved, but self-release may allow an individual to self-exam themselves to determine if a problem exits. The ability to self-exam is unique and warranted. The combination of a stretch while doing a self-muscle release could become a new therapeutic and performance enhancement technique. This technique, which is backed by good research, can become a better way to improve flexibility and muscle function and to prepare the body before physical exertion, rehabilitation and/or participation in a sport.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. An adjustable standing muscular releasing and stretching exercise device utilized by a user with a separate outside vertical support, comprising:

a vertical linear column base;

a support handle that is vertically moved and attached along said linear base, said support handle has a first inner plastic guide to increase stability and strength of said device;

a pair of adjustable releasing rollers each with a distal end on a horizontal bar with a roller connection that is movably connected to said linear base, said rollers being removably slid and secured onto said bar, said roller connection is attached to said linear base by a t-pin and locking mechanism;

a horizontal non-skid floor base that is attached to and supports said linear base;

a raised non-skid foot platform that is attached to and extends over said floor base; and a tightening pin that is perpendicularly and slidably adjustably attached to said foot platform.

2. The device according to claim 1, wherein said t-pin and locking mechanism has a second inner plastic guide to increase stability and strength of said device.

3. The device according to claim 1, wherein said rollers are removably secured on said bar by a bushing, a cap screw and a spring collar assembly on said distal end of said rollers.

* * * * *